US005356768A

United States Patent [19]

Bertramini et al.

[11] Patent Number: 5,356,768

[45] Date of Patent: Oct. 18, 1994

[54] LIGHT-SENSITIVE SILVER HALIDE COLOR PHOTOGRAPHIC ELEMENTS CONTAINING SURFACTANTS WITH A COMBINED HLB GREATER THAN 20

[75] Inventors: Walter Bertramini, Albissola Superiore; Agostino Baldassarri, Savona, both of Italy

[73] Assignee: Minnesota Mining and Manufacturing Company, St. Paul, Minn.

[21] Appl. No.: 74,977

[22] Filed: Jun. 10, 1993

Related U.S. Application Data

[63] Continuation of Ser. No. 783,541, Oct. 28, 1991, abandoned.

[30] Foreign Application Priority Data

Oct. 29, 1990 [IT] Italy ..... 21912 A/90

[51] Int. Cl.[5] ..... G03C 1/08; G03C 7/26; G03C 1/005; G03C 1/494

[52] U.S. Cl. ..... 430/546; 430/553; 430/550; 430/588; 430/631; 430/635; 430/636; 430/637

[58] Field of Search ..... 430/550, 553, 588, 546, 430/631, 635, 636, 637

[56] References Cited

U.S. PATENT DOCUMENTS

| | | | |
|---|---|---|---|
| 3,676,141 | 7/1972 | Hara et al. | 95/100 |
| 3,762,928 | 8/1973 | Willens | 430/636 |
| 3,860,425 | 1/1975 | Ono et al. | 96/82 |
| 3,912,517 | 10/1975 | Van Poucke et al. | 96/100 |
| 4,284,709 | 8/1981 | Tomka | 430/637 |
| 4,326,023 | 4/1982 | De Seyn | 430/588 |
| 4,367,283 | 1/1983 | Nakayama et al. | 430/637 |
| 4,513,081 | 4/1985 | Okazaki et al. | 430/550 |
| 4,547,459 | 10/1985 | Kamio et al. | 430/546 |
| 4,596,766 | 6/1986 | Nemori et al. | 430/637 |
| 4,882,267 | 11/1989 | Hirabayashi et al. | 430/546 |
| 4,952,488 | 8/1990 | Mihayashi et al. | 430/553 |

FOREIGN PATENT DOCUMENTS

| | | | |
|---|---|---|---|
| 2412428 | 10/1974 | Fed. Rep. of Germany . | |
| 3641861A1 | 6/1987 | Fed. Rep. of Germany . | |
| 3011935 | 1/1988 | Japan | 430/637 |
| 3060446 | 3/1988 | Japan | 430/637 |

*Primary Examiner*—Charles L. Bowers, Jr.
*Assistant Examiner*—J. Pasterczyk
*Attorney, Agent, or Firm*—Gary L. Griswold; Walter N. Kirn; Mark A. Litman

[57] ABSTRACT

Light-sensitive silver halide color photographic elements comprising a silver halide photographic emulsion layer including a) at least one 2,5-diacylamino phenol cyan coupler dissolved in low-boiling water-immiscible organic solvent droplets dispersed in said emulsion layer in reactive association with at least one non-ionic surfactant compound having a HLB higher than 20 and at least one anionic surfactant compound and b) at least one cationic carbocyanine spectral sensitizing dye.

9 Claims, No Drawings

LIGHT-SENSITIVE SILVER HALIDE COLOR PHOTOGRAPHIC ELEMENTS CONTAINING SURFACTANTS WITH A COMBINED HLB GREATER THAN 20

This is a continuation of application Ser. No. 07/783,541 filed Oct. 28, 1991, now abandoned.

FIELD OF THE INVENTION

This invention refers to light-sensitive silver halide color photographic elements having a red-sensitive silver halide emulsion layer and 2,5-diacylamino-phenol cyan couplers dispersed therein and, in particular, to light-sensitive silver halide color photographic elements having a red-sensitive silver halide emulsion layer including 2,5-diacylamino-phenol cyan couplers dissolved in water-immiscible organic solvent droplets dispersed in said emulsion layer in reactive association with a nonionic surfactant and an anionic surfactant.

BACKGROUND OF THE INVENTION

The spectral sensitizing technique of adding certain sensitizing dyes to a silver halide photographic emulsion to expand its natural light-sensitive wavelength region towards the longer wavelengths is well known in the art for preparing silver halide color photographic emulsions.

The degree of spectral sensitization is influenced by the chemical structure of the sensitizing dye, by the properties of the emulsion (for example, composition of silver halides, crystal habit, crystal form, silver ion concentration) and other characteristics. It is also influenced by the photographic additives present in the emulsion, such as stabilizer agents, antifoggants, color couplers, etc.

Combination of the sensitizing dye and the coupler to form a salt, causing the sensitizer molecules to be desorbed from the grain surface, has been since long recognised in the art (H. Meier, *Spectral Sensitization, The Focal Press,* 1968, p.52).

2,5-Diacylamino-phenol cyan couplers are known to produce cyan dyes having excellent resistance against fading as described, for example, in U.S. Pat. Nos. 4,333,999; 4,451,559; 4,465,766 and 4,554,244.

The combination of 2,5-diacylamino-phenol cyan couplers with conventional cationic cyanine dyes shows no sensitometric problem if the coupler is added to a red sensitized emulsion immediately before coating, whereas it causes a dramatic loss of red sensitivity (desensitization) if the finalled emulsion is held several hours at high temperature before coating.

With cyanine dyes having two sulfoalkyl groups, desensitization does not occur, but such cyanine dyes cause an increased sensitization of the adjacent layers of the coated film (diffusion sensitization) since they can diffuse into them under high temperature and humidity. This is a serious problem in practical use.

U.S. Pat. No.4,513,081 describes a silver halide photographic emulsion comprising a 2,5-diacylamino-cyan coupler and a merocyanine sensitizing dye which does not undergo desensitization and diffusion sensitization. The inhibition of spectral sensitization which occurs with conventional carbocyanine dyes can be prevented by using particular merocyanine dyes.

U.S. Pat. No. 3,676,141 describes a process for dispersing an organic solution of a oleophilic photographic material into an aqueous gelatin solution in the presence of at least one anionic surface active agent and at least one nonionic surface active agent. The nonionic surface active agent used is selected from anhydrohexitol esters having HLB (Hydrophilic Lipophilic Balance) values in the range of from 3.5 to 9.5. The process provides finely dispersed oleophilic photographic materials and stable dispersions. 2,5-Diacylamino-phenol couplers are not disclosed in said patent.

U.S. Pat. No. 3,860,425 describes a process for dispersing an organic solution of an oleophilic photographic material in an aqueous medium in the presence of a) at least one nonionic surface active agent containing in the molecule thereof polyoxyethylene units and polyoxypropylene units in a molar ratio from 0.1 to 0.6 and b) at least one anionic surface active agent. Said noionic surface active agents are characterized by low values of HLB (for example, Pluronic TM L-61, a nonionic surface active agent made by Wyandotte Chem. Co. and cited at col. 11 lines 17–18, has an HLB of 3). The process provides stable dispersions in which the oleophilic photographic material is finely dispersed in the aqueous medium. 2,5-Diacylaminophenol couplers are not disclosed in said patent.

U.S. Pat. No. 3,912,517 describes a method for incorporating a water-insoluble photographic ingredient into a photographic hydrophilic colloid layer which comprises dissolving said ingredient in a water-soluble organic solvent, admixing said solution with water in the presence of a surface active agent but in the absence of a hydrophilic colloid, removing said organic solvent and incorporating the dispersion thus formed into the hydrophilic colloid coating composition. The surface active agent comprises a combination of an anionic dispersing agent and a non-ionic dispersing agent so that the HLB value of the combination is between 8 and 18 inclusive. Among the examples of nonionic surface active agents in said patent is Span TM 20 (trade name of the Atlas Chemical Industries Inc., USA, for sorbitan monolaurate). The process gives improved stability of the dispersion and better coating characteristics of the hydrophilic colloid layer including said dispersion. 2,5-Diacylamino-phenol couplers are not disclosed in said patent.

SUMMARY OF THE INVENTION

The present invention provides light-sensitive silver halide color photographic elements having a silver halide emulsion layer including a) at least one 2,5-diacylamino-phenol cyan coupler dissolved in water-immiscible high-boiling organic solvent droplets dispersed in the emulsion layer in reactive association with at least one non-ionic surfactant compound and at least one anionic surfactant compound and b) at least one cationic carbocyanine spectral sensitizing dye.

It has been found with tile present invention that desensitization caused by the mutual action of 2,5-diacylamino-phenol cyan couplers and spectrally sensitizing dyes is substantially prevented.

DETAILED DESCRIPTION OF THE INVENTION

The 2,5-diacylamino-phenol cyan couplers of the present invention are represented by the formula (I):

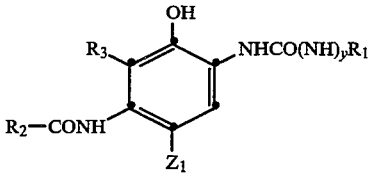

(I)

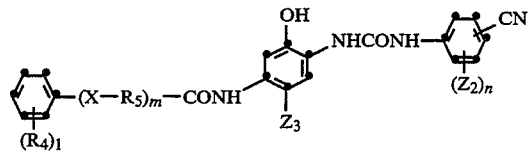

(II)

wherein $R_1$ is an aryl group, $R_2$ is an alkyl group of up to 20 carbon atoms (such as methyl, ethyl, butyl, dodecyl, etc.) or an aryl group of up to 20 carbon atoms (e.g. phenyl), $R_3$ is a hydrogen atom, a halogen atom (such as fluorine, bromine, chlorine, etc.), an alkyl group of up to 20 carbon atoms (such as methyl, ethyl, butyl, dodecyl, etc.) or an alkoxy group of up to 20 carbon atoms (such as methoxy, ethoxy, etc.), and $Z_1$ is a hydrogen atom, a halogen atom or a group which can be split off by the reaction of said coupler with the oxidized product of an aromatic primary amine-type color developing agent; y is 0 or 1.

The aryl group represented by $R_1$ of formula (I) is, e.g., a phenyl group, a naphthyl group, or other aryl group of up to 30 carbon atoms, and preferably is a phenyl group. This group is allowed to have a single substituent or a plurality of substituents; for example, typical substituents introducible to tile aryl group include halogen atoms (such as fluorine, chlorine, bromine, etc.), alkyl groups (such as methyl, ethyl, propyl, butyl, dodecyl, etc.), hydroxyl group, cyano group, nitro group, alkoxy groups (such as methoxy, ethoxy, etc.), alkylsulfonamido groups (such as methylsulfonamido, octylsulfonamido, etc.), arylsulfonamido groups (such as phenylsulfonamido, naphthylsulfonamido, etc.), alkylsulfamoyl groups (such as butylsulfamoyl), arylsulfamoyl (such as phenylsulfamoyl), alkyloxycarbonyl groups (such as methyloxycarbonyl), aryloxycarbonyl groups (such as phenyloxycarbonyl), aminosulfonamido groups, acylamino groups, carbamoyl groups, sulfonyl groups, sulfinyl groups, sulfoxy groups, sulfo groups, aryloxy groups, alkoxy groups, alkylcarbonyl groups, arylcarbonyl groups, aminocarbonyl groups, and the like. Two different members of these groups are allowed to be introduced to the aryl group. The preferred group represented by R1 is a phenyl group, the more preferred is a phenyl group having one or more substituents including halogen atoms and cyano groups.

When the term "group" is used in the present invention to describe a chemical compound or substituent, the described chemical material includes the basic group and that group with conventional substitution. Where the term "moiety" is used to describe a chemical compound or substituent, only an unsubstituted chemical material is intended to be included. For example, "alkyl group" includes not only alkyl moieties as methyl, ethyl, octyl, dodecyl, etc., but also such moieties bearing sustituent groups such as halogen, cyano, hydroxyl, nitro, amine, carboxylate, etc. On the other hand, "alkyl moiety" includes only methyl, ethyl, octyl, dodecyl, etc.

In the present invention, the preferred cyan couplers having Formula (I) are the compounds having the following formula (II):

wherein $Z_2$ is a hydrogen atom, a halogen atom (such as fluorine, bromine, chlorine, etc.) or a monovalent organic group, $R_4$ is a hydrogen atom or a substituent exemplified by a halogen atom (such as fluorine, bromine, chlorine, etc.), a hydroxyl group, a nitro group, an alkyl group of up to 20 carbon atoms (such as methyl, ethyl, iso-propyl, tert.-butyl, n-octyl, n-dodecyl, etc.), an alkyloxycarbonyl group (such as methyloxycarbonyl), an aryloxycarbonyl group (such as phenyloxycarbonyl), an alkoxy group of up to 20 carbon atoms (such as methoxy, ethoxy, etc.), an aryloxy group (such as phenoxy), an alkylcarbonyl group (such as methylcarbonyl, propylcarbonyl, octylcarbonyl, etc.), an arylcarbonyl (such as phenylcarbonyl), an acyloxy group (such as acetoxy, benzoyloxy, etc.), an alkylsulfonyl group (such as methylsulfonyl, octylsulfonyl, etc.), an arylsulfonyl group (such as phenylsulfonyl), an acyl group (such as acetyl), an acylamino group, a sulfonamido group (such as methylsulfonamido, octylsulfonamido, phenylsulfonamido, etc.), a sulfamoyl group (such as butylsulfamoyl, phenylsulfamoyl, etc.), and the like; X is an oxygen atom or a sulfur atom, R5 is a straight-chain or a branched-chain alkylene group, n is an integer of 0 to 3, m is an integer of 0 to 4 and 1 is an integer of 1 to 4, and $Z_3$ is a hydrogen atom, a halogen atom or a group which can be split off by the reaction of said coupler with the oxidised product of an aromatic primary amine type color developing agent.

Examples of monovalent group represented by $Z_2$ include a halogen atom, a nitro group, an amino group, a cyano group, a hydroxy group, a carboxy group, an alkyl group (such as methyl, ethyl, propyl, isopropyl, t-butyl, octyl, etc.), an aralkyl group (such as benzyl, phenethyl, etc.), an alkoxy group (such as methoxy, ethoxy, benzyloxy, etc.), an aryloxy group (such as phenoxy, p-nitrophenoxy, etc.), an acylamino group (such as acetylamino, propionylamino, benzoylamino, phenoxyacetylamino, etc.), a carbamoyl group (such as methylcarbamoyl, dimethylcarbamoyl, phenylcarbamoyl, diphenylcarbamoyl, etc.), a sulfonamido group (such as methanesulfonamido, butanesulfonamido, benzenesulfonamido, p-toluenesulfonamido, etc.), a sulfamoyl group (such as methylsulfamoyl, dimethylsulfamoyl, phenylsulfamoyl, etc.), an alkylcarbonyl group (such as methylcarbonyl, propylcarbonyl, octylcarbonyl, etc.), an arylcarbonyl group (such as phenylcarbonyl), an alkyloxycarbonyl group (such as methyloxycarbonyl, ethyloxycarbonyl, butyloxycarbonyl, t-butyloxycarbonyl, etc.), an aryloxycarbonyl group (such as phenyloxycarbonyl), and the like.

In the present invention, the more preferred cyan couplers having formula (I) are the compounds having the following formula (III):

(III)

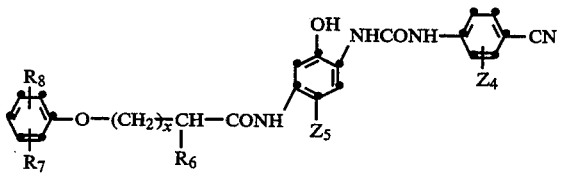

wherein $Z_4$ is a hydrogen atom or a halogen atom (such as fluorine, chlorine, bromine, etc.), $Z_5$ is a hydrogen atom or a chlorine atom, $R_6$ is a hydrogen atom or an alkyl group of up to 20 carbon atoms (such as methyl, ethyl, propyl, butyl, octyl, dodecyl, etc.), $R_7$ and $R_8$ may be either the same or different and each is a hydrogen atom, an alkyl group of up to 20 carbon atoms (such as methyl, ethyl, butyl, dodecyl, etc.) or an alkoxy group of up to 20 carbon atoms (such as methoxy, ethoxy, etc.), provided that the sum of carbon atoms of $R_6$, $R_7$ and $R_8$ is from 8 to 20, and x is an integer of 0 to 2.

In formulas (I), and (II), the groups that can be split off by the reaction of these couplers with the oxidized product of the aromatic primary amine-type color developing agents, represented by $Z_1$ and $Z_3$, are all known to those skilled in the art. Any of these groups changes the reactivity of the coupler or is split from the coupler to fulfill its development-inhibiting, bleach-inhibiting and color-compensation inhibiting functions to thereby advantageously act in the coupler-containing layers or other layers of the silver halide color photographic material. Typical examples of such groups include, for example, alkoxy groups, aryloxy groups, arylazo groups, thioether, carbamoyloxy groups, acyloxy groups, imido groups, sulfonamido groups, thiocyano group or heterocyclic groups (such as oxazolyl, diazolyl, triazolyl, tetrazolyl, etc.), and the like. The particularly preferred examples represented by $Z_1$ and $Z_3$ are a hydrogen atom or a chlorine atom.

The cyan couplers of formula (I) can readily be synthesized by use of methods well known in the art such as described, for example, in U.S. Pat. Nos. 3,758,308, 4,333,999 and 4,451,559.

Specific examples of cyan couplers represented by the formula (I) are illustrated below, but the present invention is not limited thereby.

(C-1)

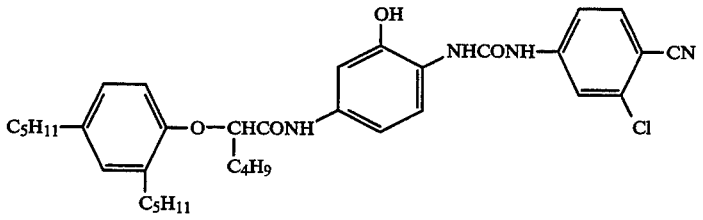

(C-2)

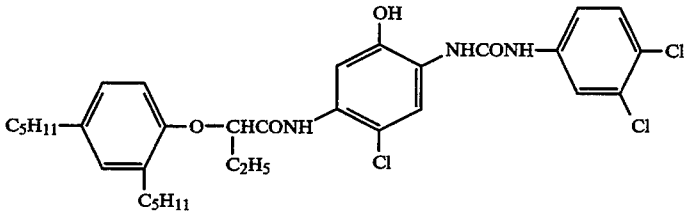

(C-3)

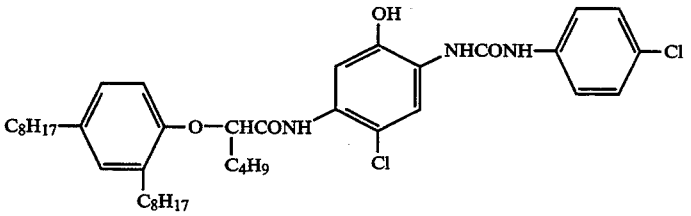

(C-4)

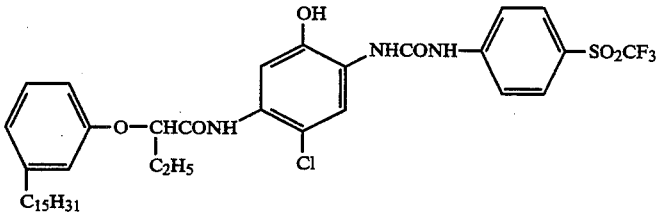

-continued
(C-5)
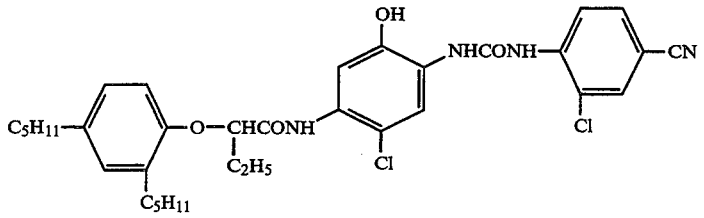
(C-6)
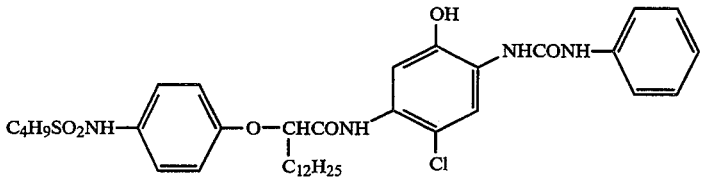
(C-7)
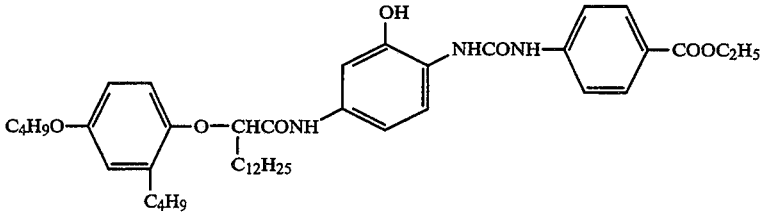
(C-8)
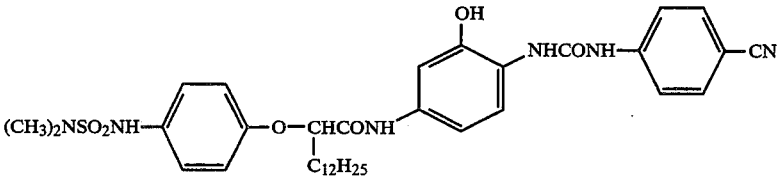
(C-9)
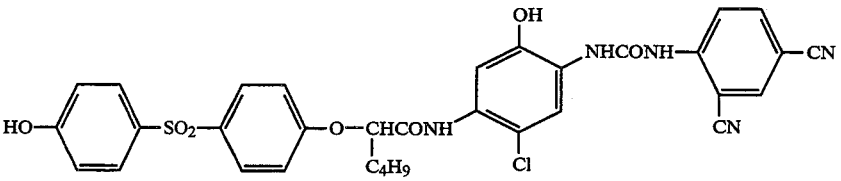
(C-10)
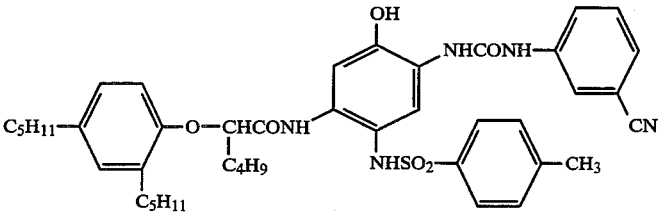
(C-11)
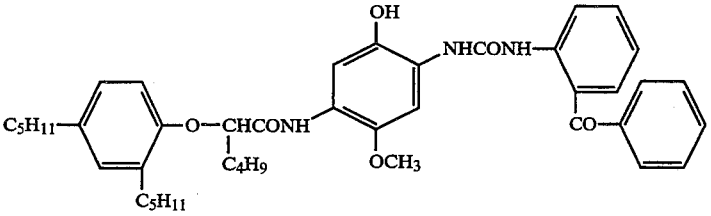

-continued
(C-12)
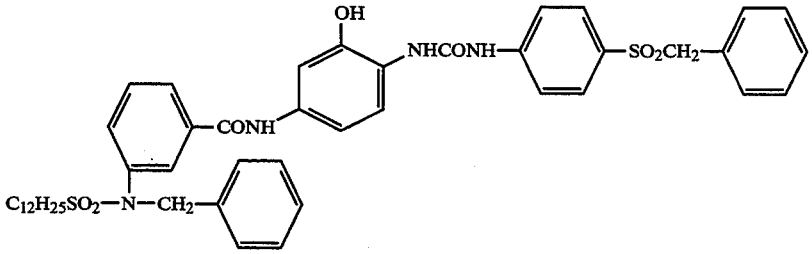
(C-13)
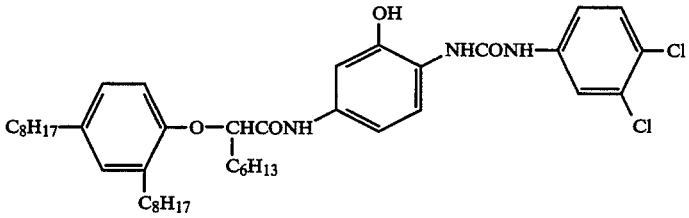
(C-14)
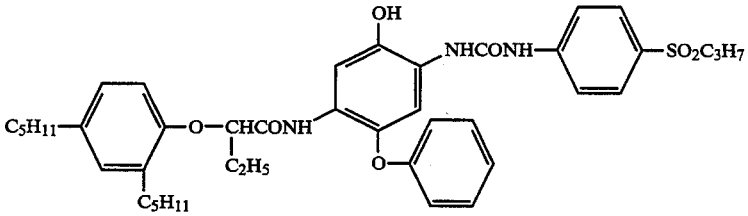
(C-15)
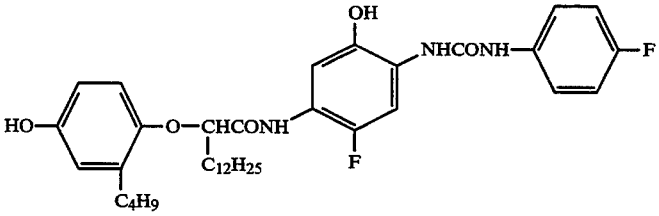
(C-16)
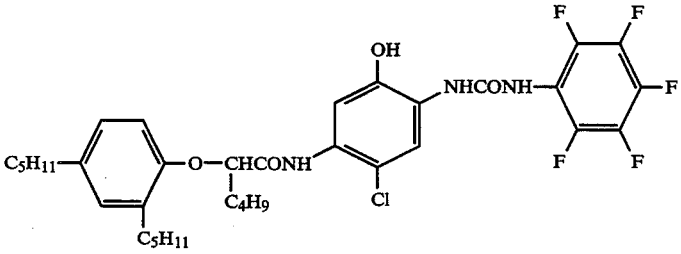
(C-17)
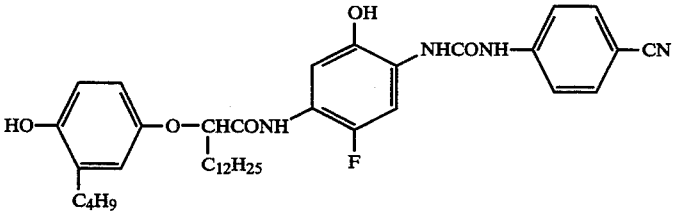
(C-18)
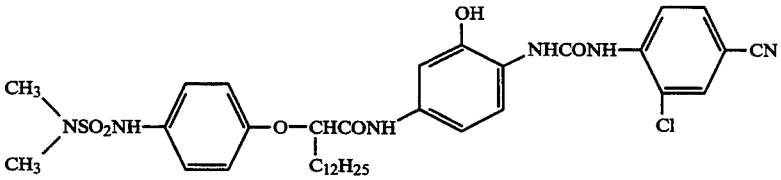

-continued (C-19)

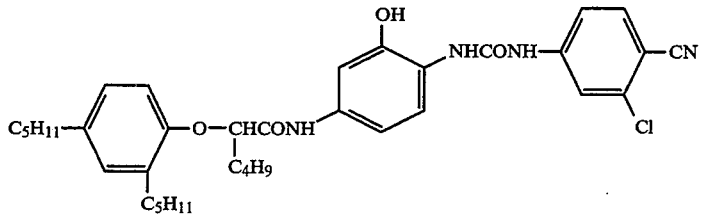

(C-20)

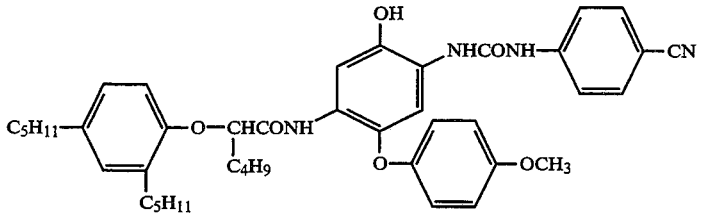

(C-21)

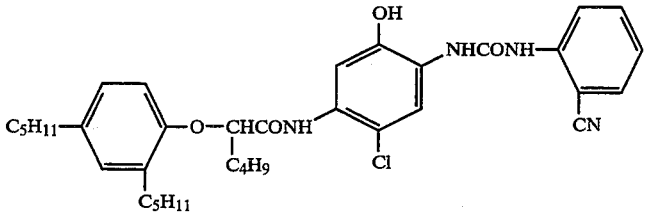

(C-22)

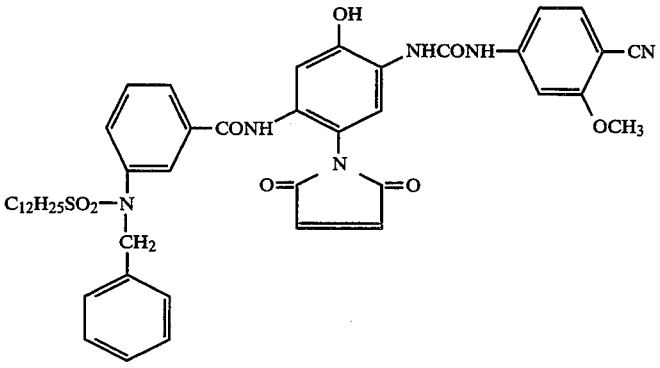

(C-23)

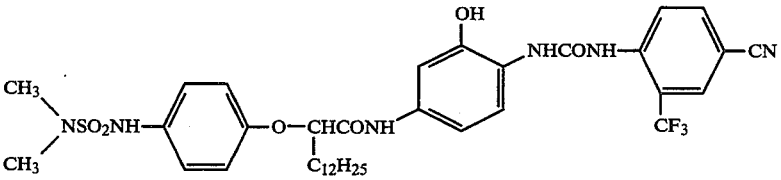

The 2,5-diacylamino-phenol cyan couplers are introduced into the hydrophilic colloidal binders of the photographic materials with the so-called dispersion technique. Briefly, according to this technique, as described in U.S. Pat. No. 2,322,027, the couplers are dissolved in water-immiscible high-boiling organic solvents (also called in the art permanent solvents, crystalloidal solvents, oil-type solvents, oil formers, and the like) and the resulting organic solution is added to an aqueous composition containing a hydrophilic colloid (gelatin) and a dispersing agent (usually an anionic surfactant). The mixture is then passed through a homogenizing apparatus (such as, for example, a colloidal mill or an ultrasonic wave generator) to form a dispersion of fine droplets of said organic solvent containing the coupler. In some cases it may be advantageous to facilitate the dissolution of the couplers by use of an auxiliary water-immiscible low-boiling organic solvent, which is removed afterwards by evaporation, as described e.g. in U.S. Pat. Nos. 2,801,170, 2,801,171 and 2,949,360. The obtained dispersion is then mixed with the hydrophilic colloid composition (gelatin silver halide emulsion or other gelatin-containing composition) which is used to form (by coating) the photographic layer. Organic solvents for dispersing photographic couplers are well known in the art, as disclosed for example in U.S. Pat. Nos. 2,322,027, 2,801,171, 2,835,579, 2,533,514, 2,554,755, 3,748,141, 3,779,765, 4,353,979, 4,430,421 and 4,430,422.

The selection of the dispersing agent needed to make the coupler dispersion and to keep it stable (free from crystallization) within the layer (including it) is important not only to the stability of the dispersion but also to the sensitometric results obtained with the combination of the 2,5-diacylamino-phenol couplers and the cationic carbocyanine spectral sensitizing dyes. The use of anionic and cationic surfactants as dispersing agents has been found to facilitate the desensitization due to the mutual action of the dispersed 2,5-diacylamino-phenol couplers with the cationic carbocyanine spectral sensitizing dyes. It is believed that they favor the desorption of the dye molecules from tile silver halide grain surface and the interaction with the couplers.

According to the present invention, the photographic material includes a red-sensitive silver halide emulsion layer comprising said 2,5-diacylamino-phenol couplers dissolved in water-immiscible organic solvent droplets, said droplets being dispersed in the hydrophilic layer in reactive association with a non-ionic surfactant having a HLB higher than 10 and an anionic surfactant. HLB (hydrophilic-lipophilic balance) is a measure of the emulsifying efficiency of a surfactant and is related to the polarity of the molecule, the least hydrophilic surfactants having low HLB numbers, and increasing numbers corresponding to increasing hydrophilic character (for a detailed definition of HLB see M. J. Schick, Surfactants Science Series, Vol. 1 Nonionic Surfactants, Chapter 18, M. Dekker Inc., New York, 1967).

Non-ionic surfactants for use in the present invention include for example:

1) Polyoxyethylene ethers of general formula $$HO-(CH_2-CH_2-O)_n-Lipid$$

wherein n is an integral number of at least 3 and Lipid is an aliphatic carbon chain of at least 12 carbon atoms. Examples of polyoxyethylene ethers are available under the trade name of BRIJ TM such as:

| Name | n | Lipid | HLB |
|---|---|---|---|
| BRIJ TM 56 | 9 | Hexadecyl | 12.9 |
| BRIJ TM 58 | 20 | Hexadecyl | 15.8 |
| BRIJ TM 35 | 20 | Dodecyl | 16.9 |

2) Polyoxyethylene Sorbitan esters of general formula

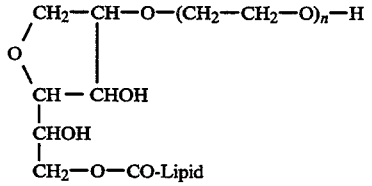

wherein n is an integral number of at least 20 and Lipid is an aliphatic carbon chain of at least 12 carbon atoms.

Examples of Polyoxyethylene Sorbitan esters are available under the trade name of TWEEN TM such as:

| Name | n | Lipid | HLB |
|---|---|---|---|
| TWEEN TM 65 | 20 | Tristearoyl | 10.5 |
| TWEEN TM 85 | 20 | Trioleoyl | 11.5 |
| TWEEN TM 60 | 20 | Stearoyl | 14.9 |
| TWEEN TM 80 | 20 | Oleoyl | 15.0 |
| TWEEN TM 40 | 20 | Palmitoyl | 15.6 |

-continued

| Name | n | Lipid | HLB |
|---|---|---|---|
| TWEEN TM 20 | 20 | Lauroyl | 16.7 |

3) Alkylphenol polyethylene glycol ethers of general formula

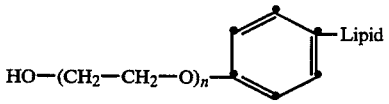

wherein n is an integral number of at least 5 and Lipid is an aliphatic carbon chain of at least 8 carbon atoms.

Examples of Alkylphenol polyethylene glycol ethers are available under the trade name of Triton TM such as:

| Name | n | Lipid | HLB |
|---|---|---|---|
| Triton TM N-57 | 5 | Nonyl | 10.0 |
| Triton TM X-45 | 5 | Octyl | 10.4 |
| Triton TM X-114 | 7-8 | Octyl | 12.4 |
| Triton TM X-100 | 9-10 | Octyl | 13.5 |
| Triton TM X-102 | 12-13 | Octyl | 14.6 |
| Triton TM X-165 | 16 | Octyl | 15.8 |
| Triton TM X-305 | 30 | Octyl | 17.3 |
| Triton TM X-405 | 40 | Octyl | 17.9 |

The anionic surfactants for use in the present invention comprise ampiphilic substances having in their molecule both a hydrophobic hydrocarbon group, preferably having about 8 to about 30 carbon atoms, and an hydrophilic $-SO_3M$ group or $-OSO_3M$ group, wherein M is hydrogen, an alkali metal atom such as Na, K and Li or an ammonium group such as $NH_4$. These anionic surfactants are well known in the art and are illustrated, for example, in A. W. Schwartz and J. W. Perry, *Surface Active Agents*, Interscience Publications. Representative non-limitative examples of anionic surfactants include the sulfates and sulfonates of branched-chain or straight-chain aliphatic primary and secondary alcohols having at least 8 carbon atoms and ethoxylated derivatives thereof, sulfonated monoglycerides, sulfated monoethanol amides and ethoxylated derivatives thereof, half-esters or diesters of sulfosuccinic acid and salts of benzimidazole sulfonic acid having a long alkyl chain in the 2 position. Specific examples of anionic surfactants for use in the present invention are:

$C_{12}H_{25}OSO_3Na$ $C_{14}H_{29}OSO_3Na$ $C_{12}H_{25}SO_3Na$ $C_{14}H_{29}SO_3Na$ $C_{18}H_{37}SO_3Na$ $C_{18}H_{37}OSO_3Na$

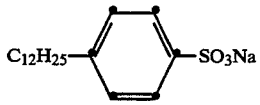

-continued

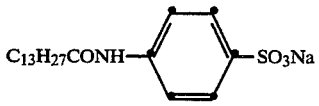

$C_{12}H_{25}CONHCH_2CH_2SO_3Na$ $CH_3(CH_2)_7CH{=}CH(CH_2)_7COOCH_2CH_2SO_3Na$ $CH_3(CH_2)_7CH{=}CH(CH_2)_7CON(CH_3)CH_2CH_2SO_3Na$

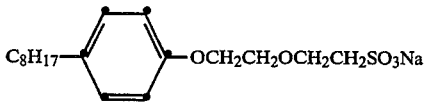

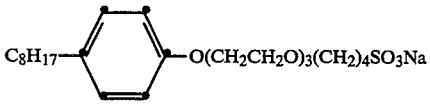

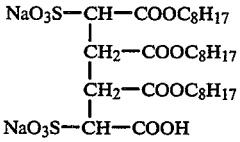

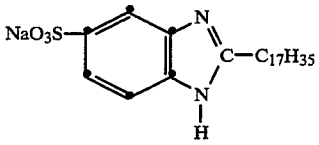

The cationic carbocyanine sensitizing dye used in the present invention comprise two basic heterocyclic nuclei joined by a linkage of three methine groups, preferably at least one of said heterocyclic nuclei being a benzothiazolium nucleus. The heterocyclic nuclei preferably include fused benzene rings.

Examples of heterocyclic nuclei include quinolinium, benzoxazolium, benzothiazolium, benzoselenazolium, benzimidazolium, naphthoxazolium, naphthothiazolium and naphthoselenazolium quaternary salts.

The preferred cationic carbocyanine sensitizing dyes are thiacarbocyanine sensitizing dyes represented by the following formula (IV):

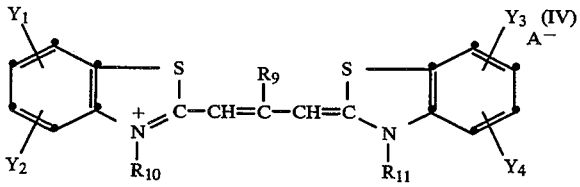

wherein $Y_1$, $Y_2$, $Y_3$ and $Y_4$ each represents a hydrogen atom, a halogen atom (e.g. chlorine, bromine, iodine and fluorine), a hydroxy group, an alkoxy group (e.g. methoxy, ethoxy, etc.), an amino group (e.g. amino, methylamino, dimethylamino, etc.), an acylamido group (e.g. acetamido, propionamido, etc.), an acyloxy group (e.g. acetoxy group, etc.), an alkoxycarbonyl group (e.g. methoxycarbonyl, ethoxycarbonyl, butoxycarbonyl, etc.), an alkyl group (e.g. methyl, ethyl, isopropyl, etc.), an alkoxycarbonylamino group (e.g. ethoxycarbonylamino, etc.), or an aryl group (e.g. phenyl, tolyl, etc.), or $Y_1$ and $Y_2$, and respectively $Y_3$ and $Y_4$, can be the atoms necessary to form a benzene nucleus (so that the heterocyclic nucleus results in, for example, an $\alpha$-naphthothiazole nucleus, a $\beta$-naphthothiazole or a $\beta,\beta'$-naphthothiazole); $R_9$ represents a hydrogen atom or an alkyl group (e.g. methyl, ethyl, etc.); $R_{10}$ and $R_{11}$ may be either the same or different and each is $(CH_2)_{n1}$—X wherein X is H, F, Cl, Br, aryl group, alkyl group of 1 to 4 carbon atoms, cycloalkyl of 3 to 7 carbon atoms or alkoxy group of 1 to 3 carbon atoms, and $n_1$ is an integer from 1 to 6; A is a artionic group (e.g. Br, Cl, I, aryl or alkyl sulfonate, tetrafluoroborate, hexafluorophosphate).

The alkyl groups included in said substituents $Y_1$, $Y_2$, $Y_3$, $Y_4$, $R_9$, $R_{10}$ and $R_{11}$ and, more particularly, the alkyl portions of said alkoxy, alkoxycarbonyl, alkoxycarbonylamino, hydroxyalkyl, acetoxyalkyl groups each preferably contain from 1 to 12, more preferably from 1 to 4 carbon atoms, tile total number of carbon atoms included in said groups preferably being no more than 20.

The aryl groups included in said substituents $Y_1$, $Y_2$, $Y_3$, $Y_4$, $R_{10}$ and $R_{11}$ each preferably contain from 6 to 18, more preferably from 6 to 10 carbon atoms, the total number of carbon atoms included in said groups not exceeding 20 carbon atoms. The following are specific examples of cationic thiacarbocyanine spectral sensitizing dyes for use in the present invention:

(S-1)

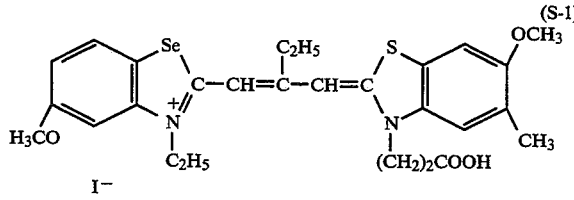

(S-2)

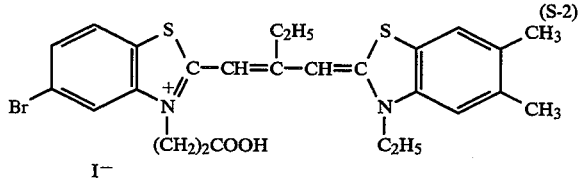

(S-3)

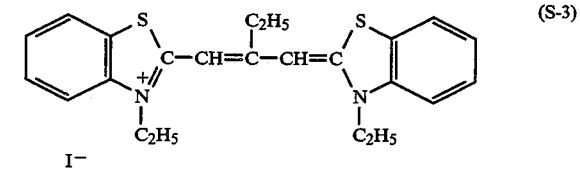

(S-4)

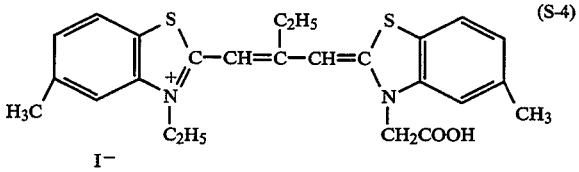

(S-5)

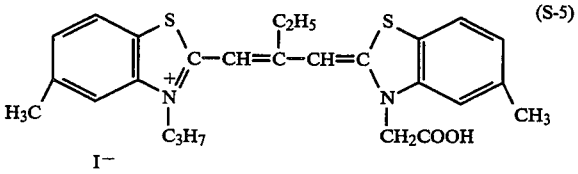

-continued

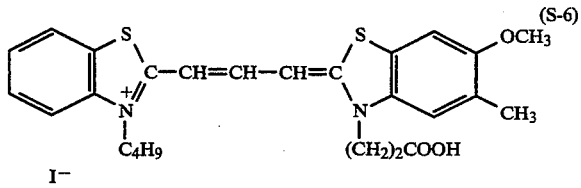

(S-6)

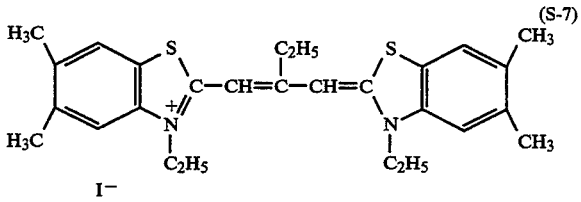

(S-7)

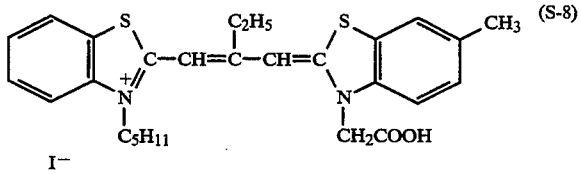

(S-8)

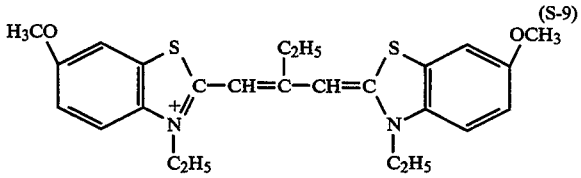

(S-9)

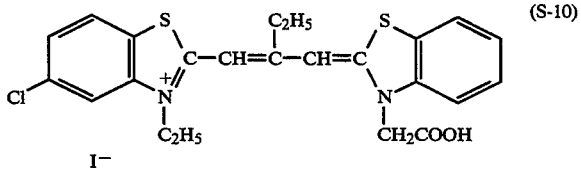

(S-10)

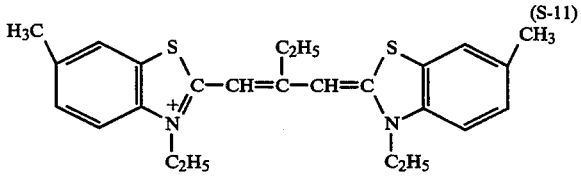

(S-11)

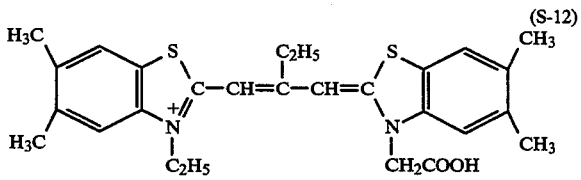

(S-12)

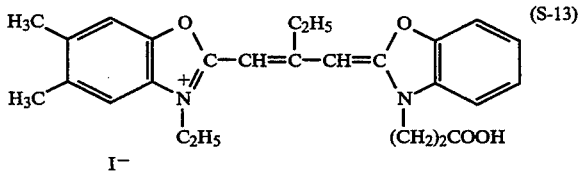

(S-13)

-continued

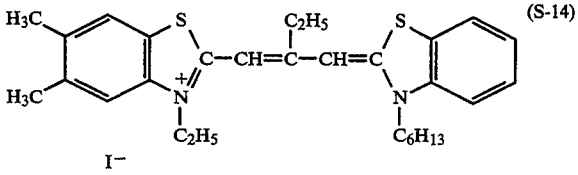

(S-14)

In the preparation of the dispersion of the 2,5-diacylamino-phenol cyan couplers in accordance with this invention, usually the amount of the water-immiscible high-boiling organic solvent is dependant upon the solubility therein of the particular 2,5-diacylamino-phenol coupler used: it can vary within very wide limits but is also preferably restricted to a minimum, such as in the range of from 30 to 150 % by weight relative to the weight of the 2,5-diacylamino-phenol coupler to be dispersed. The total amount of the anionic surfactant compound and the nonionic surfactant compound used in the practice of the present invention depends upon the structure of the 2,5-diacylamino-phenol coupler used, the kind and amount of the organic solvent for dispersion, but an especially effective total amount of said surfactant compounds ranges from 1 to 30% by weight relative to the weight of 2,5-diacylamino-phenol to be dispersed. Within this range, the amount of nonionic surfactant compound is generally comprised between 30 and 70% by weight, preferably 40 to 60% by weight relative to the total amount of anionic and nonionic surfactant compounds; more preferably, the amounts of anionic surfactant compound and nonionic surfactant compound are equivalent. The amounts of the combination of anionic and nonionic surfactant compounds are such that an HLB value higher than 20 is obtained. The anionic and nonionic surfactant compounds employed in making the dispersion of the 2,5-diacylamino-phenol couplers into aqueous gelatin according to the present invention may be both present in the aqueous gelatin into which the organic solution of the 2,5-diacylamino-phenol coupler has to be dispersed. Alternatively, the nonionic surfactant compound is used at the stage of dissolving the 2,5-diacylamino-phenol coupler in the organic solvent, whereas the anionic surfactant compound is used at the step of dispersing the organic solution in the aqueous gelatin.

The silver halide emulsions for use in the photographic element according to this invention may be chemically sensitized using the usual sensitizing agents. Sulfur containing compounds, gold and noble metal compounds, polyoxylakylene compounds are particularly suitable. Methods for chemically sensitizing silver halide emulsions are described, for example, in Research Disclosure 17643, Section III, 1978.

The usual antifoggants and stabilizers may be used as described in Research Disclosure 17643, Section VI, 1978, such as azaindenes.

Other suitable addenda, such as hardeners, coating aids, plasticizers, matting agents, developing agents, color couplers, absorbing and scattering materials, which may be added to the silver halide emulsions are described in Research Disclosure 17643, 1978.

The silver halide color photographic elements of the present invention comprise at least one blue-sensitive silver silver halide emulsion layer, at least one green-sensitive silver halide emulsion layer and at least one silver halide red-sensitive silver halide emulsion layer, said layers being associated with yellow, magenta and cyan dye-forming couplers. As used herein, the word "associated" means that the cyan dye-forming couplers according to the present invention and the silver halide emulsions are positioned in such a way as to image-wise produce in the photographic layers upon coupling with the oxidized aromatic primary amine-type developing agents very stable cyan indoaniline dyes. Such cyan couplers may be incorporated in the silver halide emulsion layers, in an adjacent layer or in the processing solutions. In a preferred form, the cyan couplers are incorporated in the silver halide emulsion layer.

Couplers other than the 2,5-diacylamino-phenol couplers for use in the photographic elements according to the present invention can be introduced into the silver halide emulsion layer using conventional methods as known to the skilled in the art. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. Nos. 4,214,047 and 4,199,363 and in EP patent 14,921. It consists of mixing a solution of the couplers in a water-miscible organic solvent with a polymeric latex consisting of water as a continous phase and of polymeric particles having a mean diameter ranging from 0.02 to 0.2 micrometers as a dispersed phase.

Another useful method is the Fisher process. According to such a process, couplers having a water-soluble group, such as a carboxyl group, a hydroxy group, a sulfonic group or a sulfonamido group, can be added to the photographic layer for example by dissolving them in an alkaline water solution.

The 2,5-diacylamino-phenol couplers according to the present invention are generally incorporated into a red-sensitive silver halide emulsion layer to form one of the differently sensitized silver halide emulsion layers of a multilayer color photographic material. Such material generally comprises a support base having coated thereon one or more red-sensitive silver halide emulsion layers, one or more green-sensitive silver halide emulsion layers, one or more blue-sensitive silver halide emulsion layers and additionally filter layers, interlayers, protective layers and sub-layers. The layer units can be coated in any conventional order, but in a preferred layer arrangement the red-sensitive layers are coated nearest the support and are overcoated by the green-sensitive layers, a yellow filter layer and the blue-sensitive layers.

More preferably, the red-sensitive silver halide emulsion layer, associated according to this invention with the cyan couplers of Formula (I), is composed of two or more silver halide emulsion layers sensitized to the same spectral region of the visible spectrum, the uppermost silver halide emulsion layer of which having the highest sensitivity and the lowermost silver halide emulsion layer having the lowest sensitivity, as described in GB patent 923,045, in FR patent 2,043,433 and in U.S. Pat. No. 4,582,780. Most preferably, the uppermost red-sensitive silver halide emulsion layer having the highest sensitivity comprises the cyan couplers of Formula (I).

The most useful yellow-forming couplers are conventional open-chain ketomethylene type couplers. Particular examples of such couplers are benzoylacetanilide type and pivaloyl acetanilide type compounds. Yellow-forming couplers that can be used are specifically described in U.S. Pat. Nos. 2,875,057, 3,265,506, 3,408,194, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77.

The most useful magenta-forming couplers are conventional pyrazolone type compounds, indazolone type compounds, cyanoacetyl compounds, pyrazoletriazole type compounds, etc, and particularly preferred couplers are pyrazolone type compounds. Magenta-forming couplers are described for example in U.S. Pat. Nos. 2,600,788, 2,983,608, 3,062,653, 3,127,269, 3,311,476, 3 ,419,391, 3,519,429, 3,558,319, 3,582,322, 3,615,506, 3,834,908 and 3,891,445,in DE patent 1,810,464, in DE patent applications 2,408,665, 2,417,945, 2,418,959 and 2,424,467 and in JP patent applications 20,826/76, 58 ,922/77, 129,538/74, 74,027/74, 159,336/75, 42,121/77, 7 4,028/74, 60,233/75, 26,541/76 and 55,122/78.

Colored couplers can be used which include those described for example in U.S. Pat. Nos. 3,476,560, 2,521,908 and 3,034,892, in JP patent publications 2,016/69, 22,335/63, 11,304/67 and 32,461/69, in JP patent applications 26,034/76 and 42,121/77 and in DE patent application 2,418,959.

DIR (Development Inhibitor Releasing) couplers can be used which include those described for example in U.S. Pat. Nos. 3,227,554, 3,617,291, 3,701,783, 3,790,384 and 3,632,345, in DE patent applications 2,414,006, 2,454,301 and 2,454,329, in GB patent 953,454, in JP patent applications 69,624/77, 122,335/74 and 16,141/76.

In addition to DIR couplers, some other compounds which release development inhibitors upon development can also be present in the light-sensitive material. Such kind of DIR compounds is described for example in U.S. Pat. Nos. 3,297,445 and 3,379,529, in DE patent application 2,417,914, in JP patent applications 15,271/77 and 9,116/78.

Two or more kinds of the couplers described above can be incorporated in the same layer, or the same coupler can also be present in two or more layers.

The layers of the photographic material can contain various colloids, alone or in combination, such as binding materials, as for example described in Research Disclosure 17643, IX, December 1978.

The above described emulsions can be coated onto several support bases (cellulose triacetate, paper, resin-coated paper, polyester, and the like) by adopting various methods, as described in Research Disclosure 17643, XV and XVI, December 1978.

The present invention is not limited to photographic materials with a particular type of emulsion or silver halides. It can therefore find an application with photographic materials containing different types of emulsions or silver halides, such as for example those described in Research Disclosure 17643, I, December 1978.

The silver halide emulsions prepared according to the process of this invention may be used as photosensitive emulsions for various photographic materials, such as high surface sensitivity or high internal sensitivity negative emulsions, surface-fogged or unfogged direct-positive emulsions, print-out emulsions, reversal emulsions, emulsions for black-and-white materials, for color materials, radiographic materials, transfer color materials, and the like.

The photographic elements, including a silver halide emulsion prepared according to this invention, may be processed to form a visible image upon association of the silver halides with an alkaline aqueous medium in the presence of a developing agent contained in the medium or in the material, as known in the art. Suitable developing compounds are in particular the p-phenylenediamine derivatives, for example 2-amino-5-diethylamino-toluene chlorydrate (called CD2), 2-amino-N-ethyl-N-(β-methanesulfonamido)-m-toluidine sesquisulfate monohydrate (called CD3), and 4-amino-3-methyl-N-ethyl-N-(β-hydroxyethyl)-aniline sulfate (called CD4).

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e. g. EDTA.Fe.$NH_4$, wherein EDTA is the ethylenediaminotetracetic acid. While processing, this bath is continously aired to oxidize the divalent iron which forms while bleaching the silver image and regenerated, as known in the art, to maintain the bleach effectiveness. The poor control of these operations may cause the loss of cyan density of the dyes.

Further to the above mentioned oxidizing agents, the blix bath contains known fixing agents, such as for example ammonium or alkali metal thiosulfates. Both bleaching and fixing baths can contain other additives, e.g. polyalkyleneoxide derivatives, as described in GB patent 933,008 in order to increase the effectiveness of the bath, or thioethers known as bleach accelerators.

The present invention will now be illustrated by the following examples, but not limited to them.

EXAMPLE 1

A photographic silver chlorobromide emulsion having 5.13 mol % chloride, 87.7 mol % bromide and 7.17 mol % iodide with an average grain size of 0.43 pm was chemically sensitized with gold, thiocyanate, p-toluenesulfonate and p-toluenethiosulfonate, then stabilized with N-ethyl-benzothiazolium iodide.

The above emulsion was then divided into five parts and each part was finalled at 38° C. to give the compositions 1 to 5 as follows:

1) A methanolic solution of 0.046 moles/mol Ag of the above described red sensitizer (S-1) and 0.286 moles/-mol Ag of the above described red sensitizer (S-2) was added to the emulsion to get a coverage of 0.332 moles of the two dyes per mol of Ag; tile emulsion was held for 20 minutes under stirring, then it was added the stabilizer 4-hydroxy-6-methyl-tetrazaindene, Hostapur TM SAS (a trade mark of Hoechst AG, West Germany, for an alkane sulfonate) as coating surfactant, and 0.094 moles/mol Ag of the above described cyan coupler (C-1). The dispersion of the cyan coupler (C-1) was prepared dissolving 6 g of the coupler in 3.25 ml of tricresylphosphate, 3.25 ml of butylacetanilide and 9 ml of ethylacetate, adding the resulting solution to 32 ml of 10% aqueous gelatin containing 5 ml of a 10% by weight aqueous solution of Hostapur TM SAS, stirring with a high speed rotating mixer to effect dispersion and adding water to 100 g.
2) The emulsion was added to the same additions of composition 1 above but using as dispersing agent for the cyan coupler in addition to Hostapur*TM* SAS the nonionic surfactant Triton TM X-100 (trade mark of Rohm and Haas Co., West Germany, for an octylphenol polyethylene glycol ether having an HLB value of 13.5) in an amount of 0.5 g per 100 g of the coupler dispersion.
3) The emulsion was added to the same additions of composition 2 above but without using Hostapur SAS as coating aid. (4) The emulsion was added to the same additions of composition 2 above but using Triton TM X-100 as coating aid.
5) The emulsion was added with the same additions of composition 1 above but using as dispersing agent for the cyan coupler in addition to Hostapur TM SAS the nonionic surfactant Span TM 20 (trade mark of ICI Specialty Chemicals for a polyoxyethylene sorbitan monolaurate having a HLB value of 8.6) in an amount of 0.5 g per 100 g of the coupler dispersion.

Each of the compositions was coated on a cellulose triacetate base, at a silver coverage of 2 g per square meter, at 30 minutes after the end of finalling (coatings 1–5); the same compositions were each coated after 15 hours holding at 40° C. under stirring (coating 6–10).

A gelatin layer containing monochloro-dihydroxy-triazine hardener was coated on each film as protective topcoat. The films were kept 7 days at room conditions to let them harden, then exposed through a continous wedge at 5500° C., processed in a standard Kodak EP-2 color chemistry process as described in U.S. Pat. No. 4,346,873, then read by an automatic densitometer.

Table 1 compares the speed values (expressed as DIN numbers) of the film samples (1 to 5) obtained by coating the compositions 1 to 5 above after the end of finalling with the speed values of the sample films (6 to 10) obtained by coating the same compositions 1 to 5 after 15 hours holding at 40° C. under stirring. The speed values were measured at values of optical density of 0.20+Dmin and 1.00+Dmin.

TABLE 1

| Comp. | Films | Speed 0.2 + Dmin | Speed 1.00 + Dmin |
|---|---|---|---|
| 1 | 1 (comp.) | 19.9 | 13.2 |
| 1 | 6 (comp.) | 17.1 | 10.2 |
| 2 | 2 (inv.) | 20.0 | 13.3 |
| 2 | 7 (inv.) | 19.0 | 12.7 |
| 3 | 3 (inv.) | 20.0 | 13.1 |
| 3 | 8 (inv.) | 19.4 | 12.4 |
| 4 | 4 (inv.) | 19.9 | 12.4 |
| 4 | 9 (inv.) | 20.5 | 12.2 |
| 5 | 5 (comp.) | 19.2 | 12.5 |
| 5 | 10 (comp.) | 17.3 | 11.0 |

It can be seen the loss of speed of the film 6 versus film 1, containing Hostapur TM SAS both as coating surfactant and dispersing agent for the coupler (C-1). On the contrary, it can be seen (films 2, 3 and 4 versus, respectively, films 7, 8 and 9) that no substantial desensitization occurs when the nonionic surfactant Triton TM X-100 is used as further surfactant during dispersion of coupler (C-1). The film 5 compared with film 10, both containing the non ionic surfactant Span TM 20 having a HLB value of 8.6 in addition to Hostapur TM SAS, does not show the same behaviour of films 2, 3 and 4.

EXAMPLE 2

Following the procedure for preparing the film 2 of Example 1, several films were prepared having the 2,5-diacylamino-phenol coupler dispersed with the aid of the nonionic surfactants Brij TM 35 (trademark of Atlas Chemical Ind. for a polyoxyethylene dodecyl ether having a HLB value of 16.9), Triton TM X-164 (trademark of Rohm and Hass Co. for an octylphenol polyethylene glycol ether having a HLB value of 15.8), Tween TM 20 (trademark of Atlas Chemicals Co. for a polyoxyethylene sorbitan monolaurate having a HLB value of 16.7), and Triton TM X-405 (trade mark of Rohm and Haas Co. for an octylphenol polyoxyethyleneglycol ether having a HLB value of 17.9). The emulsion composition of each film was coated after 1 hour holding at 40° C. and after 15 hours holding at 40° C. The loss of speed was similar to that obtained with film 2 of Example 1 but substantially lower compared with the loss of speed obtained with a film similar to film 1 of Example 1.

We claim:

1. A light-sensitive silver halide color photographic element comprising a silver halide emulsion layer including a) at least one 2,5-diacylaminophenol cyan coupler dissolved in water-immiscible immiscible high-boiling organic solvent droplets dispersed in said emulsion layer in reactive association with at least one non-ionic surfactant compound having a HLB higher than 10 and at least one anionic surfactant compound, the combination of said surfactants providing a HLB value higher than 20, and b) at least one cationic carbocyanine spectral sensitizing dye comprising two heterocyclic nuclei joined by a linkage of three methine groups.

2. The light-sensitive silver halide color photographic element of claim 1 wherein said 2,5-diacylaminophenol cyan coupler is represented by the formula (I):

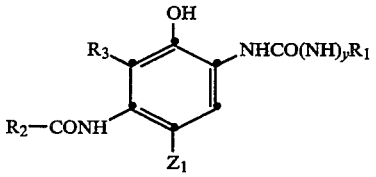

(I)

wherein $R_1$ is an aryl group, $R_2$ is an alkyl group or an aryl group, $R_3$ is a hydrogen atom, a halogen atom, an alkyl group or an alkoxy group, and $Z_1$ is a hydrogen atom, a halogen atom or a group which can be split off by the reaction of said coupler with the oxidised product of an aromatic primary amine-type color developing agent and y is 0 or 1.

3. The light-sensitive silver halide color photographic element of claim 1 wherein said 2,5-diacylaminophenol cyan coupler is represented by the formula (II):

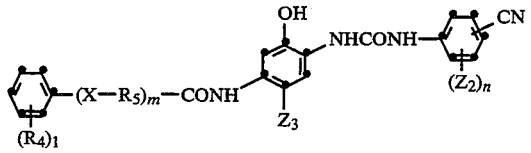

(II)

wherein $Z_2$ is a hydrogen atom, a halogen atom or a monovalent organic group, $R_4$ is a hydrogen atom, a halogen atom, a hydroxyl group, a nitro group, an alkyl group, an alkyloxycarbonyl group, an aryloxycarbonyl group, an alkoxy group, an aryloxy group, an alkylcarbonyl group, an arylcarbonyl group, an acyloxy group, an alkylsulfonyl group, an arylsulfonyl group, an acyl group, an acylamino group, a sulfonamido group, a sulfamoyl group, X is an oxygen atom or a sulfur atom, $R_5$ is a straight-chain or a branched-chain alkylene group, n is an integer of 0 to 3, m is an integer of 0 to 4 and 1 is an integer of 1 to 4, and $Z_3$ is a hydrogen atom, a halogen atom or a group which can be split off by the reaction of said coupler with the oxidised product of an aromatic primary amine-type color developing agent.

4. The light-sensitive silver halide color photographic element of claim 1, wherein said 2,5-diacylaminophenol cyan coupler is represented by tile formula (III):

(III)

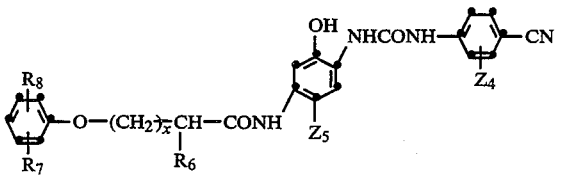

wherein $Z_4$ is a hydrogen atom or a halogen atom, $Z_5$ is a hydrogen atom or a chlorine atom, $R_6$ is a hydrogen atom or an alkyl group, $R_7$ and $R_8$ may be either the same or different and each is a hydrogen atom, an alkyl group or an alkoxy group, provided that the sum of carbon atoms of $R_6$, $R_7$ and $R_8$ is from 8 to 20, and x is an integer of 0 to 2.

5. The light-sensitive silver halide color photographic element of claim 1, wherein said cationic carbocyanine spectral sensitizing dyes are represented by the formula (IV):

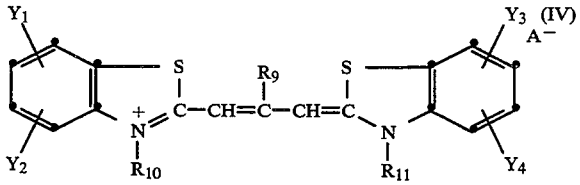

(IV)

wherein $Y_1$, $Y_2$, $Y_3$ and $Y_4$ independently represent a hydrogen atom, a halogen atom, a hydroxy group, an alkoxy group, an amino group, an acylamino group, an alkoxycarbonyl group, an alkyl group, an alkoxycarbonylamino group, or an aryl group, or, together, $Y_1$ and $Y_2$ and, respectively $Y_3$ and $Y_4$, form the atoms necessary to complete a benzene ring, $R_9$ is hydrogen or a low molecular weight alkyl group having 1 to 3 carbon atoms, $R_{10}$ and $R_{11}$ may be either the same or different and each is $(CH_2)_{n1}$—X wherein X is H, F, Cl, Br, an aryl group, an alkyl group of 1 to 4 carbon atoms, cycloalkyl of 3 to 7 carbon atoms or an alkoxy group of 1 to 3 carbon atoms; nl is an integer from 1 to 6; and A is an anionic group.

6. The light-sensitive silver halide color photographic element of claim 1, wherein said non-ionic surfactant compounds are selected within the group consisting of polyoxyethylene ethers, polyoxyethylene sorbitan esters and alkylphenol polyethylene glycol ethers.

7. The light-sensitive silver halide color photographic element of claim 1, wherein said anionic surfactant compounds are selected within the group of anionic surfactant compounds having both a hydrophobic hydrocarbon group and an $—OSO_3M$ group or an $—SO_3M$ group, wherein M represents a monovalent cation.

8. The light-sensitive silver halide color photographic element of claim 1, wherein the total amount of the anionic surfactant compound and the nonionic surfactant compound is from 1 to 30% by weight relative to the weight of the 2,5-diacylamino-phenol coupler.

9. The light-sensitive silver halide color photographic element of claim 8, wherein the amount of the nonionic surfactant compound is from 30 to 70% by weight relative to the total amount of the anionic and nonionic surfactant compounds.

* * * * *

UNITED STATES PATENT AND TRADEMARK OFFICE

CERTIFICATE OF CORRECTION

PATENT NO. : 5,356,768

DATED : October 18, 1994

INVENTOR(S) : Beltramini et al.

It is certified that error appears in the above-indentified patent and that said Letters Patent is hereby corrected as shown below:

On the title page, under item [19] and item [75], change "Bertramini" to --Beltramini--.

Column 2, line 59, delete "tile"

and insert --the--.

Column 3, line 28, delete "tile"

and insert --the--.

Column 16, line 11, delete "artionic"

and insert --anionic--.

Column 16, line 19, delete "tile"

and insert --the--.

UNITED STATES PATENT AND TRADEMARK OFFICE

CERTIFICATE OF CORRECTION

PATENT NO. : 5,356,768

DATED : October 18, 1994

INVENTOR(S) : Beltramini et al.

It is certified that error appears in the above-indentified patent and that said Letters Patent is hereby corrected as shown below:

Column 21, line 56, delete "0.43 pm"

and insert --0.43 µm--.

Column 21, line 68, delete "then it was"

and insert --then to it was--.

Column 22, line 14, delete "to the"

and insert --with the--.

Column 22, line 22, delete "to the"

and insert --with the--.

Column 22, lines 24-25, delete "to the"

and insert --with the--.

UNITED STATES PATENT AND TRADEMARK OFFICE

CERTIFICATE OF CORRECTION

PATENT NO. : 5,356,768

DATED : October 18, 1994

INVENTOR(S) : Beltramini et al.

It is certified that error appears in the above-indentified patent and that said Letters Patent is hereby corrected as shown below:

Column 22, line 43, delete "5500°C.,"
and insert --55°C.,--.
Column 23, line 37, delete the second
occurrence of "immiscible".
Column 24, line 26, delete "tile"
and insert --the--.

Signed and Sealed this

Twenty-first Day of March, 1995

Bruce Lehman

*Attest:*

BRUCE LEHMAN

*Attesting Officer*

*Commissioner of Patents and Trademarks*